US010873133B2

(12) United States Patent
Farzaneh et al.

(10) Patent No.: US 10,873,133 B2
(45) Date of Patent: Dec. 22, 2020

(54) DIPOLE ANTENNA ARRAY ELEMENTS FOR MULTI-PORT BASE STATION ANTENNA

(71) Applicant: Communication Components Antenna Inc., Kanata (CA)

(72) Inventors: Sadegh Farzaneh, Kanata (CA); Jacob Van Beek, Kanata (CA); Minya Gavrilovic, Kanata (CA); Nasrin Hojjat, Kanata (CA)

(73) Assignee: Communication Components Antenna Inc., Kanata (CA)

( * ) Notice: Subject to any disclaimer, the term of this patent is extended or adjusted under 35 U.S.C. 154(b) by 486 days.

(21) Appl. No.: 15/498,565

(22) Filed: Apr. 27, 2017

(65) Prior Publication Data

US 2017/0317420 A1 Nov. 2, 2017

Related U.S. Application Data

(60) Provisional application No. 62/328,349, filed on Apr. 27, 2016.

(51) Int. Cl.

| | |
|---|---|
| ***H01Q 21/26*** | (2006.01) |
| ***H01Q 9/06*** | (2006.01) |
| ***H01Q 5/30*** | (2015.01) |
| ***H01Q 1/24*** | (2006.01) |
| ***H01Q 1/36*** | (2006.01) |

(52) U.S. Cl.

CPC ..... *H01Q 9/065* (2013.01); *H01Q 1/246* (2013.01); *H01Q 1/36* (2013.01); *H01Q 5/30* (2015.01)

(58) Field of Classification Search

CPC ..... H04B 7/15; H04B 7/145; H01Q 9/065; H01Q 5/30; H01Q 1/246; H01Q 1/36; H01Q 5/385; H01Q 21/26; H01Q 5/378; H01Q 5/40

See application file for complete search history.

(56) References Cited

U.S. PATENT DOCUMENTS

| | | | | |
|---|---|---|---|---|
| 2014/0043195 | A1* | 2/2014 | Ho | H01Q 1/526 343/770 |
| 2014/0139387 | A1* | 5/2014 | Jones | H01Q 21/30 343/794 |
| 2014/0333501 | A1* | 11/2014 | Chainon | H01Q 9/065 343/833 |

* cited by examiner

*Primary Examiner* — Dameon E Levi
*Assistant Examiner* — David E Lotter
(74) *Attorney, Agent, or Firm* — Sofer & Haroun, LLP

(57) ABSTRACT

A dipole antenna array element using crossed dipoles is provided. The arms of the crossed dipoles are spaced apart from a ground plane. The length of the arms of the crossed dipoles, as well as the height of the array element, is dependent on the lowest wavelength of signal for which the element is to be used with. To adjust the impedance of the antenna array element, a strip of conductive material is used to enclose an area about the arms of the dipoles. A patch component can also be used with the arms being between the patch component and the ground plane.

14 Claims, 12 Drawing Sheets

DIPOLE ANTENNA ARRAY ELEMENTS FOR MULTI-PORT BASE STATION ANTENNA

RELATED APPLICATIONS

This application is a non-provisional patent application which claims the benefit of U.S. Provisional Application No. 62/328,349 filed on Apr. 27, 2016.

TECHNICAL FIELD

The present invention relates to antennas. More specifically, the present invention relates to physically small hybrid high band and low band antenna elements and the antenna arrays in which they may be used.

BACKGROUND

The telecommunications revolution of the late 20th and early 21st century has led to the development and proliferation of more and more communications devices. Recent estimates have shown that there are almost 10 mobile or cellular handsets for every person on earth. One offshoot of such phenomenal growth in handset proliferation is the concomitant demand for coverage. After all, a mobile phone handset is only useful if one is in an area where there is mobile phone service coverage.

This demand for greater areas of mobile service coverage has also led a demand for the various means for providing that coverage. As such, antennas and antenna arrays that can be used for the various signals usable by such handsets are in great demand. Smaller antenna arrays with more signal capabilities are, of course, more desirable than large, clunky, and less capable arrays. To this end, antenna array elements which are physically small and which can be used in multi-function antenna arrays are most desirable as they provide the most flexibility in antenna array design. Ideally, such antenna array elements can be configured for use with various signal frequencies and frequency ranges.

Ideally, such configurable antenna array elements are also cost-effective and are not susceptible to interference or interaction with other antenna elements in the same array. From the above, there is therefore a need for antenna array elements that are configurable for use with various frequencies and which can be used in different antenna array configurations.

SUMMARY

The present invention relates to antenna array elements. A dipole antenna array element using crossed dipoles is provided. The arms of the crossed dipoles are spaced apart from a ground plane. The length of the arms of the crossed dipoles, as well as the height of the array element, is dependent on the wavelength of the lowest frequency signal for which the element is to be used with. To adjust the impedance of the antenna array element, a strip of conductive material is used to enclose an area about the arms of the dipoles. A patch component is also used with the arms being between the patch component and the ground plane.

In a first aspect, the present invention provides a dipole antenna comprising:

a pair of arms extending outwardly from a center and spaced apart from a ground plane, said pair of arms having a combined length ranging from $0.25\lambda$ to $0.50\lambda$;

wherein said dipole antenna has a height ranging from $0.15\lambda$ to $0.25\lambda$ as measured from said ground plane;

$\lambda$ being equal to a wavelength of a lowest frequency of a signal to be used with said dipole antenna.

In a second aspect, the present invention provides an antenna array comprising:

a plurality of antenna elements, at least one of said plurality of antenna elements being of a first kind of antenna element, said first kind of antenna element having a structure comprising:

two pairs of first arms extending outwardly from a first center and spaced apart from a first ground plane, said pairs of first arms having a combined length ranging from $0.25\lambda_1$ to $0.28\lambda_1$, said first kind of antenna element having a height ranging from $0.15\lambda_1$ to $0.25\lambda_1$ as measured from said first ground plane;

at least one first strip of conductive material enclosing an area around said pairs of first arms, said at least one first strip being spaced apart from and physically unconnected with said pairs of first arms, said at least one first strip being for modifying an overall impedance of said first kind of antenna element;

a patch component for modifying an impedance of said first kind of antenna element, said patch component being a patch of conductive material located such that said pairs of first arms is between said patch component and said first ground plane;

wherein $\lambda_1$ is equal to a wavelength of a lowest frequency of a first signal to be used with said first kind antenna element;

said antenna array is for use with signals having a frequency ranging from 698 MHz to 2800 MHz.

In a third aspect, the present invention provides a dipole antenna element comprising:

two pairs of arms extending outwardly from a center and spaced apart from a ground plane;

at least one strip of conductive material enclosing an area around said pairs of arms, said at least one strip being spaced apart from and physically unconnected with said pairs of arms, said at least one strip being for modifying an overall impedance of said antenna element; and a patch component for modifying an impedance of said antenna element, said patch component being a patch of conductive material located such that said pairs of arms is between said patch component and said ground plane.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
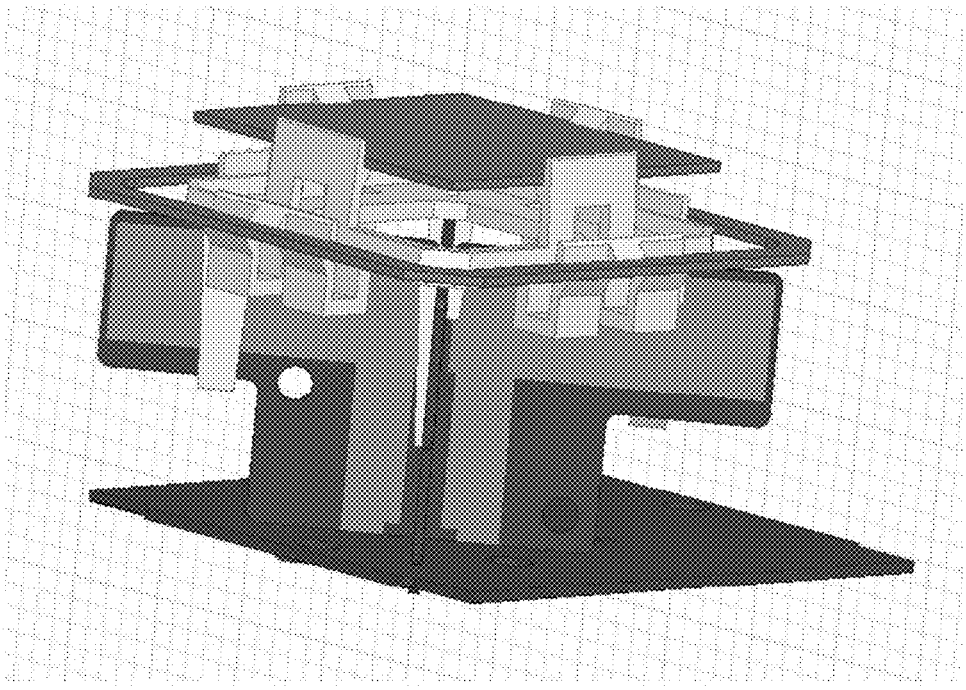
FIG. 1 is an isometric view of a high band antenna array element according to one aspect of the invention.

Referring to FIG. 1, a crossed dipole antenna element according to one aspect of the invention is illustrated. The embodiment illustrated in FIG. 1 is configured for use with signals ranging from 1695-2800 MHz. An exploded view of the components in the antenna element in FIG. 1 is provided in FIG. 2.

Figure 2:
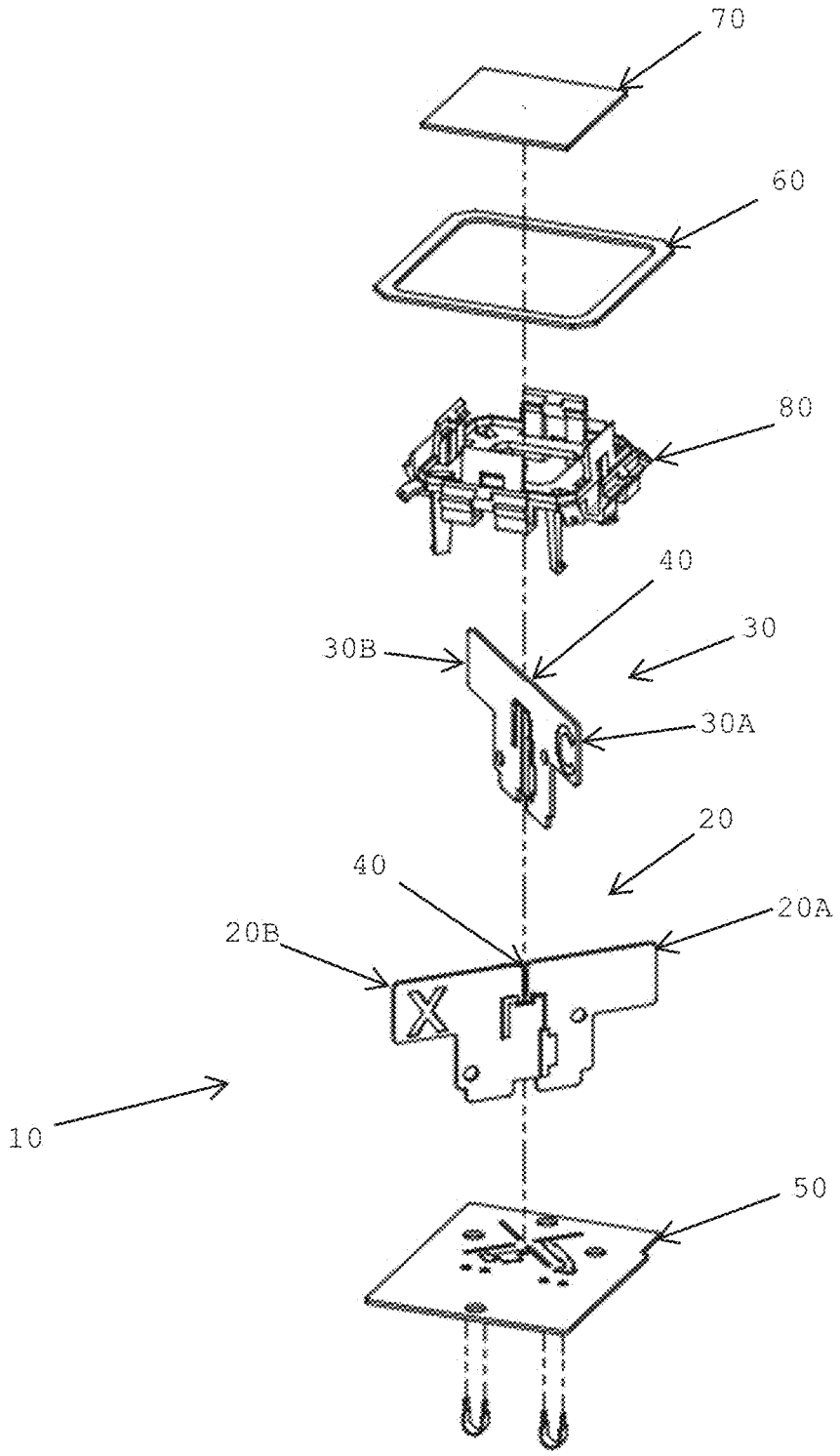
FIG. 2 is an exploded view of the antenna array element in FIG. 1.

Referring to FIG. 2, the antenna array element 10 uses a first dipole 20 and a second dipole 30 in a crossed configuration. Each dipole has arms 20A, 20B, 30A, 30B, each of which extends outwardly from a base 40 and is spaced apart from a ground plane 50. A strip 60 of conductive material is used to encircle an area about the dipoles 20, 30 and the strip is used to adjust the impedance of the antenna element 10. To widen the bandwidth of the element 10, a patch component 70 can also be used. As can be seen from the Figures, the patch component 70 is located so that the dipoles 20, 30 (and their arms) are between the component 70 and the ground plane 50. A frame or scaffold 80 is used to hold the strip 60 and the patch component 70 in place.

It should be clear that the frame 80 is constructed from non-conductive material (e.g. plastic) and, as such, the strip 60 is physically unconnected to either dipole 20, 30 and is similarly unconnected to any conductive material on the array element 10. Similarly, the patch component 70 is also physically unconnected to any part of the array element 10 other than the frame 80 and is physically unconnected to any conductive material on the array element 10. As can be seen in the Figures, the patch component 70 is spaced apart from the base 40 and from the dipoles 20, 30.

It should further be noted that, for each dipole, the length of the dipole (i.e. the combined length of each the arms 20A, 20B or arms 30A, 30B or the distance from one edge of a dipole to the other opposite edge) is dependent on the wavelength of the lowest frequency in the frequency range for which the antenna element is to be used for. In one implementation, the antenna element is configured for use with signals ranging in frequency from 1695-2800 MHz. As such, the length of the dipoles for this implementation would be dependent (i.e. a fraction or multiple of) on the wavelength for signals having a frequency of 1695 MHz. Experiments have shown that the length of the dipoles should range from 0.25λ to 0.5λ where λ is the wavelength of the lowest frequency signal for which the antenna element is to be used with. In one configuration for a high band antenna element, the dipole length was set at approximately 0.28λ. This configuration was for an antenna element to be used with signals in the 1695-2690 MHz range.

It should also be noted that the height of the antenna element is also dependent on the wavelength of the lowest frequency signal for which the antenna element is to be used with. The height is determined to be the distance from the ground plane to the top of the antenna element. Experiments have shown that this antenna element height can range from 0.15λ to 0.25λ where λ is the wavelength of the lowest frequency signal for which the antenna element is to be used with. In one configuration for a high band antenna element, the antenna height was set at approximately 0.15λ. This configuration was for an antenna element to be used with signals in the 1695-2690 MHz range.

It should further be noted that the size of the strip enclosing or encircling an area about the dipoles may also be dependent on the wavelength of the lowest frequency of the signal frequency range for the antenna element. In the configuration for the high band antenna element, the perimeter/circumference or distance covered as one traverses the strip is approximately equal to one wavelength of the lowest operating frequency. Thus, if the operating range for the high band antenna element is to be between 1695-2690 MHz, the strip may have a length (when unrolled)/perimeter/circumference approximately equal to one wavelength of a signal with a frequency of 1695 MHz. It should be noted that the perimeter for the strip (or the strip effective length) can be determined as the perimeter for a regular right rectilinear shape which encompasses the area covered by the antenna arms. Thus, for a cross shaped strip, the perimeter would be considered as the perimeter of a square that covers or encompasses the whole cross shaped strip.

The strip may be constructed from any suitable conductive material with sufficient rigidity to retain its shape and which can be used with a suitable frame or scaffold. As can be imagined, the frame suspends the strip in a fixed position relative to the dipoles. The strip is capacitively coupled to the dipoles and, as such, maintaining the strip at a distance of a few millimeters from the dipoles have resulted in suitable coupling between the strip and the rest of the antenna element.

Regarding the patch component, the patch can be constructed from any suitable conductive material that, again, retains its shape while being maintained at a specific distance and orientation from the dipoles. As can be seen from FIG. 1, the patch component is located above the dipoles and the dipoles are between the patch component and the ground plane. Preferably, the size of the patch component is such that the component resonates at the higher frequencies of the frequency range for the antenna element.

For clarity, it should be noted that both the strip and the patch component are used to adjust the overall impedance of the antenna element. Both the strip and the patch can have multiple embodiments. As examples, while the strip in FIGS. 1 and 2 has a square configuration, the strip may also have circular configuration or a cross configuration (i.e. the strip outlines a cross) or any other shape or configuration suitable for adjusting the impedance of the antenna array element. As well, while FIGS. 1 and 2 only illustrate the use of a single strip, multiple strips may be used. In contrast to FIG. 1, where the strip is placed between the patch component and the dipoles, the strip may be placed between the dipoles and the ground plane. Similarly, a configuration where the dipoles are between two strips is also possible. As noted above, the strip perimeter (or strip effective length) can be determined by the square that covers the whole area occupied by the antenna element.

Regarding the patch component, this component may also have any number of shapes. While FIG. 1 illustrates a filled in square shape, other shapes, such as a filled in circle, a hollow or outlined square or circle, or any other suitable shape, are possible.

Figure 2A:
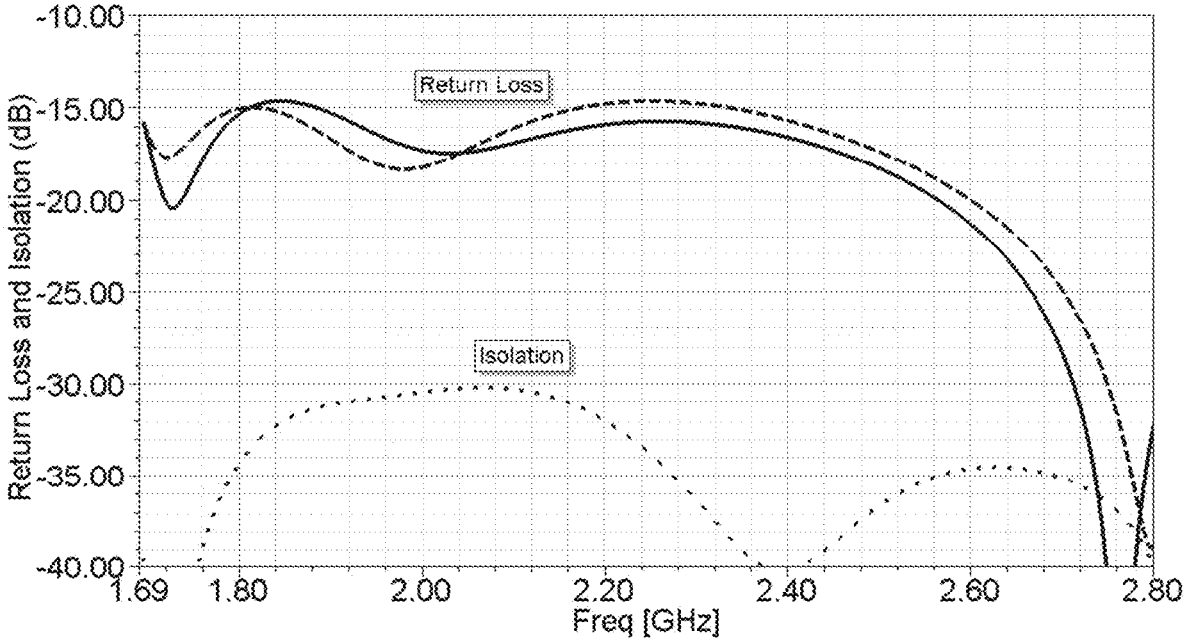
FIG. 2A is a plot detailing the performance of the antenna array element illustrated in FIG. 1

The performance of the antenna array element illustrated in FIGS. 1 and 2 can be seen in FIG. 2A. The plot shows return loss and cross-polarization isolation performance for the high band antenna array element.

Figure 3:
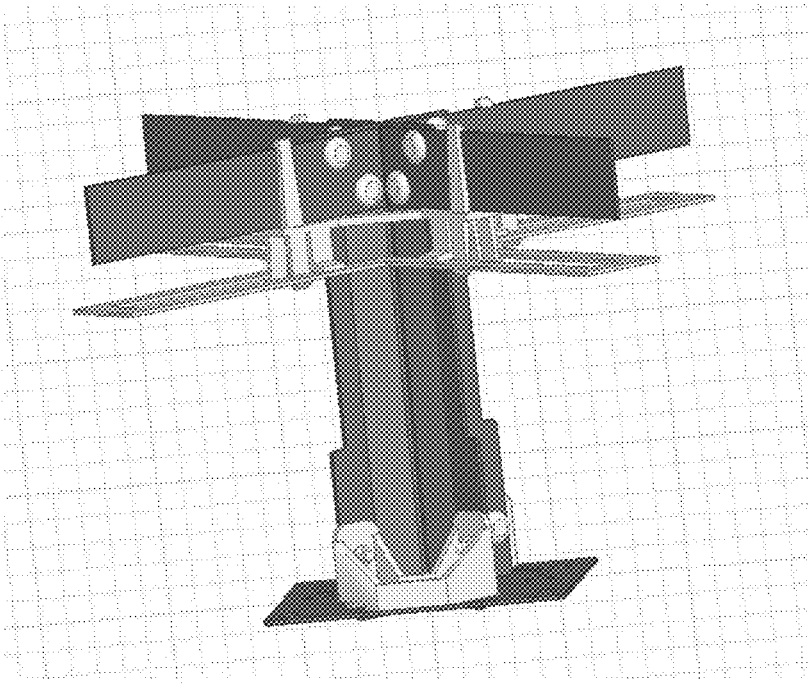
FIG. 3 is an isometric view of a low band antenna array element according to another aspect of the invention
Figure 4:
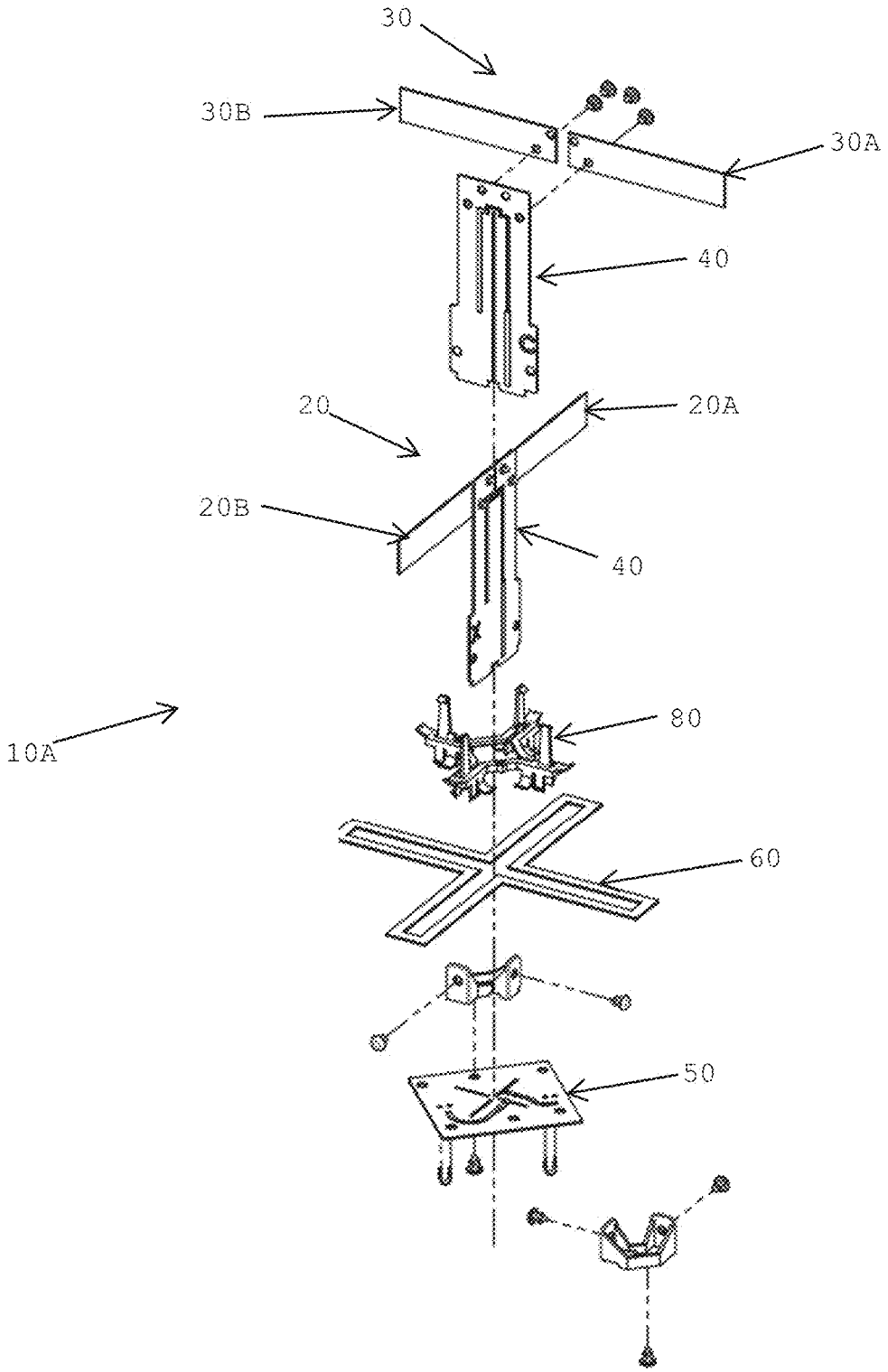
FIG. 4 is an exploded view of the antenna array element in FIG. 3.

Referring to FIG. 3 is another configuration of an antenna array element according to another aspect of the invention. The antenna array element 10A in FIG. 3 is configured for use with low band signal frequencies. Referring to FIG. 4, an exploded view of the antenna array element 10A in FIG. 3 is illustrated.

In FIGS. 3 and 4, it can be seen that the dipoles 20, 30 are in a cross configuration and that the arms 20A, 20B, 30A, 30B extend outwardly from a base 40. The strip 60 has a cross configuration (i.e. it traces a perimeter of the dipoles) and is suspended from a frame 80. However, in contrast to the antenna array element 10 in FIGS. 1 and 2, the strip 60 in FIGS. 3 and 4 is positioned between the dipoles 20, 30 and the ground plane 50. As well, instead of a single unitary piece that includes the dipole arms and the base as in the element 10 in FIGS. 1 and 2, the antenna array element 10A in FIGS. 3 and 4 uses discrete parts for the dipoles. Each dipole 20, 30 has a base 40 to which each arm of the dipole is riveted using non-conductive rivets. This can best be seen with reference to arms 30A, 30B of dipole 30 and base 40 in FIG. 4.

It should be clear that in the embodiment illustrated in FIGS. 3 and 4, the arms of the dipoles are capacitively coupled to the circuitry of the antenna element. There is no direct physical electrical connection between the arms of the dipole and the antenna array element. Similar to the strip 60, the coupling between the arms and the rest of the circuitry on the antenna array element is capacitive. It should be clear that the strip 60 is not directly connected electronically to the antenna array element. The strip 60 is only capacitively connected to the antenna array element and the frame 80 is non-conductive. Thus, electronically, the strip 60 and the arms of the dipoles are all isolated from the rest of the antenna array element and are only coupled capacitively to the circuitry. As noted above, the effective length of the strip, for this embodiment, is the perimeter of a square that encompasses or covers the cross shaped strip or the whole two dimensional area covered by the arms of the antenna element.

Similar to the embodiment illustrated in FIGS. 1 and 2, the length of the dipole arms and the total height of the antenna array element in the embodiment in FIGS. 3 and 4 are dependent on the wavelength of the lowest frequency of signals for which the antenna array element is to be used with. Thus, the dipole length ranges from 0.25L to 0.5L and a height that ranges from 0.15L to 0.25L where L is the wavelength of the lowest frequency signals for which the antenna array element is to be used with. In the specific embodiment illustrated in FIGS. 3 and 4, the antenna array element is for use with low band signals and covers the 698-960 MHz frequency band. For this embodiment, configured for low-band frequencies, the dipole length is approximately 0.33L and the antenna element height is approximately 0.18L. As with the embodiment illustrated in FIGS. 1 and 2, the strip 60 modifies the overall impedance of the antenna array element.

It should be clear that regardless of whether an antenna element is for high frequency band use or for low frequency band use, the antenna element height and the antenna dipole length (i.e. the length from one end of the dipole to the other end of the same dipole) is related to the wavelength of the lowest frequency for which the antenna element is to be used with. The antenna height can range from 0.15λ to 0.25λ. The dipole length can range from 0.25λ to 0.5λ. For both these features, λ is the wavelength of the lowest frequency for which the antenna is to be used with. As can be imagined, by having an antenna as small as possible, more elements can be placed in an array. Experiments have shown that, at its physically smallest, an antenna can have an antenna height of 0.15λ and a dipole length of 0.25λ with, of course, λ depending on whether a high band or a low band antenna is desired.

Regarding manufacturing and fabrication of the various embodiments of the invention, the base may be constructed of a PCB (printed circuit board) and the arms in the embodiment in FIGS. 1 and 2 may be conductive traces on the PCB directly coupled to the rest of the circuitry on the antenna array element. The arms in the embodiment in FIGS. 3 and 4 may be conductive plates that are riveted or bolted to the base constructed from PCBs using non-conductive bolts or rivets. As with the embodiment in FIGS. 1 and 2, the strip 60 may be constructed from conductive material that suitably retains its form while being suspended from or attached to the frame 80.

Figure 9:
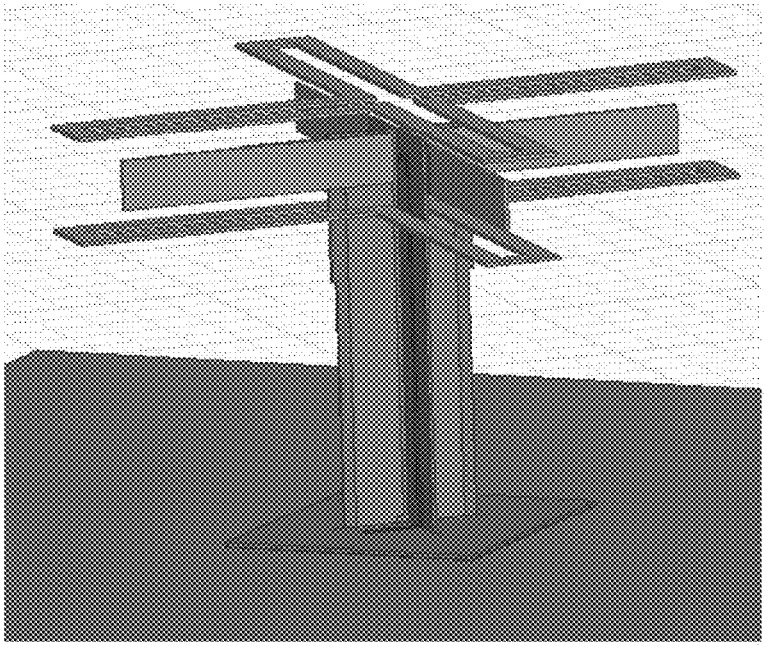
Figure 10:
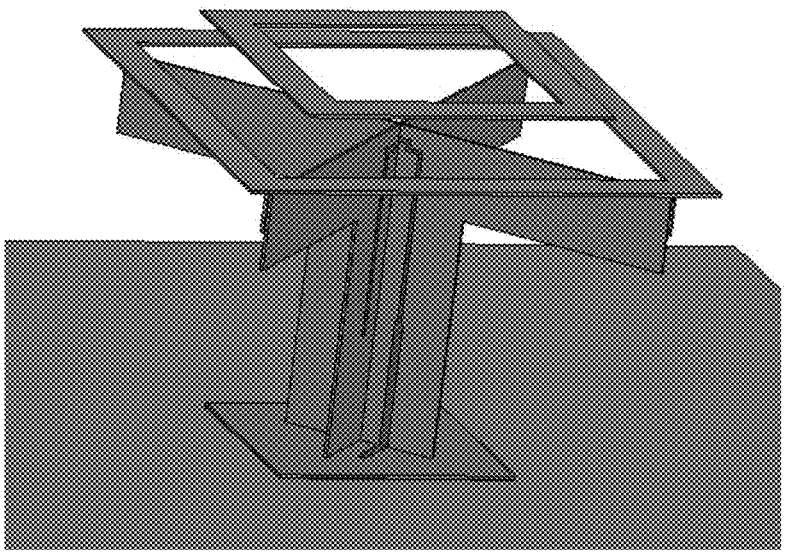
Figure 11:
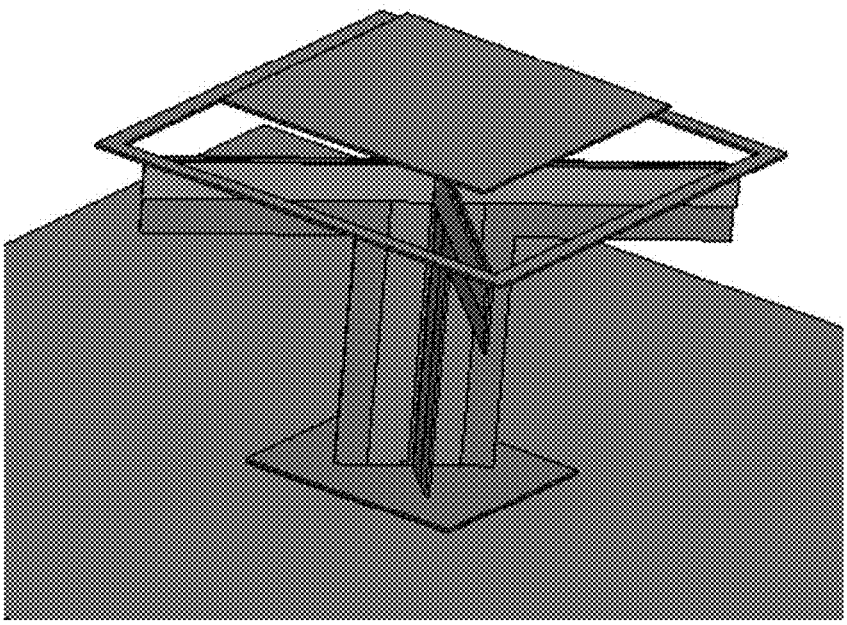

It should be noted that while the embodiments in FIGS. 1-4 illustrate two configurations, other configurations are, of course, possible. FIGS. 5-11 illustrate some of these possible configurations. FIGS. 5-8 illustrate high band dipole antenna array elements while FIGS. 9-11 illustrate low band dipole antenna array elements.

Figure 5:
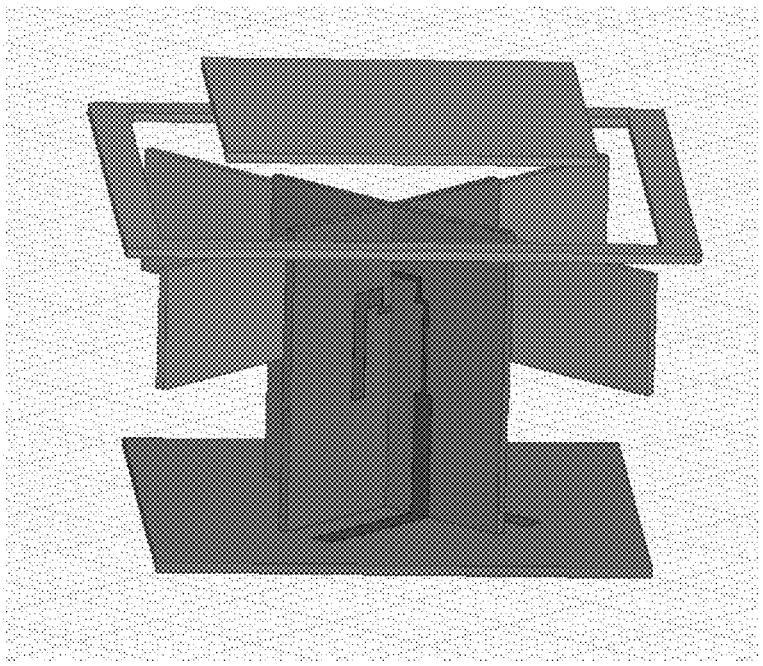
FIGS. 5-11 illustrate variants of the low band and high band antenna array elements according to various aspects of the invention.

FIG. 5 shows a high band antenna array element in which the dipole arms are capacitively coupled and not directly coupled to the circuitry in the array element. This embodiment also uses a square patch component and a square shaped configuration for the strip. The strip is located between the patch component and the dipoles in this configuration.

Figure 6:
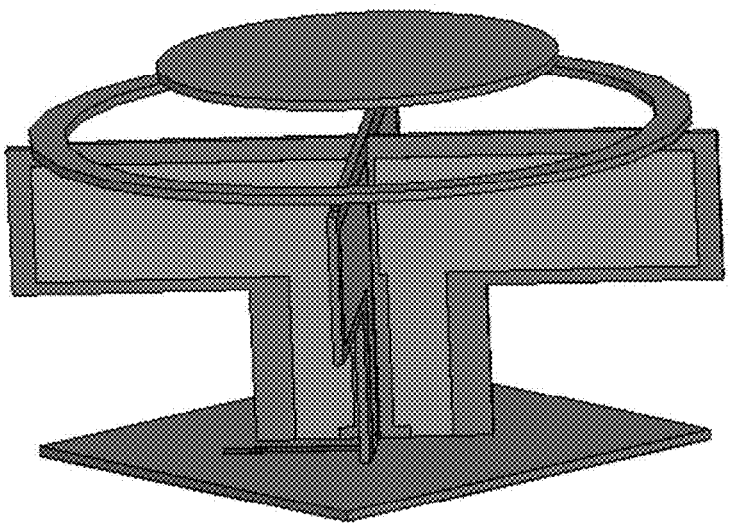

In FIG. 6, the arms of the dipole are directly coupled (not capacitively coupled) to the circuitry in the antenna array element. For this configuration, the strip is in a circular configuration and the patch component is also constructed and arranged as a circular patch. Again, the strip is located between the patch component and the dipoles in this arrangement.

Figure 7:
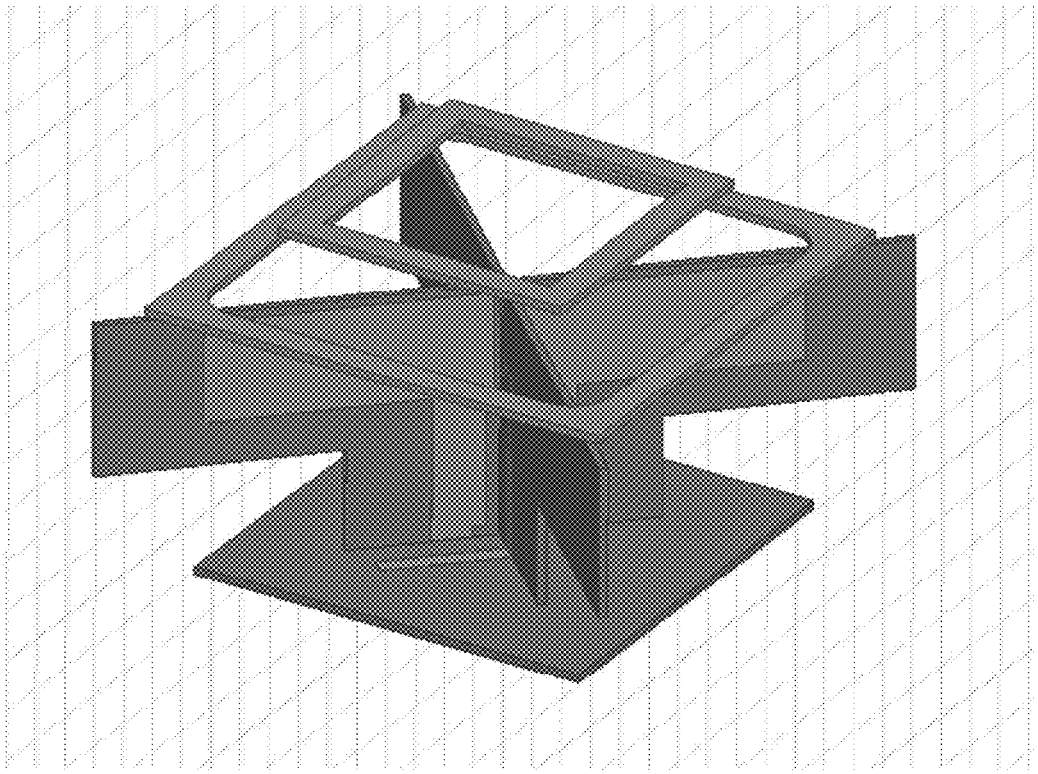

In FIG. 7, the arms of the dipoles are electronically directly connected to the circuitry of the antenna array and the strip is located between the patch component and the dipoles. The strip is configured as a square arrangement and the patch component is constructed as a hollow square (i.e. a smaller version of the strip).

Figure 8:
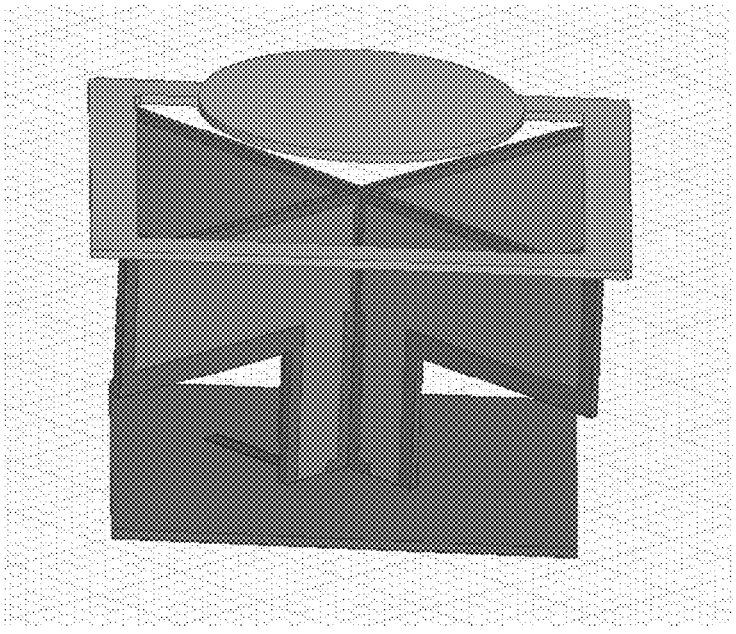

In FIG. 8, a square configuration is used for the strip and a circular patch component is used. The arms of the dipole are directly electronically coupled to the circuitry of the antenna array element in this embodiment.

FIG. 9 illustrates a low band antenna array element which uses capacitively coupled dipole arms along with two strips in a cross configuration. In this embodiment, the arms are similar in configuration to the arms in the embodiment shown in FIGS. 3 and 4 in that the arms are not directly coupled to the circuitry on the array element. Two strips of conductive material are used to adjust the overall impedance of the array element in this configuration. Both strips are in a cross configuration (i.e. both follows the cross-sectional outline of the cross-dipoles) with the dipole arms being between the two strips. As can be seen, one strip is between the dipole arms and the ground plane while the other strip is spaced apart and above the dipoles.

Referring to FIG. 10, the low band dipole antenna array element illustrated uses a square strip configuration and a patch component in a hollow square configuration. The strip is located between the patch component and the dipoles. It should be noted that the patch and strip configuration for this embodiment is similar to that illustrated in FIG. 7. The embodiment illustrated in FIG. 7 is designed for use with high band frequencies (1695 MHz-2800 MHz) while the embodiment illustrated in FIG. 10, while similar, is for use with low band frequencies (698 MHz-960 MHz).

In FIG. 11, the low band cross dipole antenna array element uses directly coupled dipole arms (i.e. directly coupled to the array element circuitry) along with a square patch component and a square strip configuration.

It should be noted that the low band and the high band embodiments of the antenna array element can both be used in a single antenna array. The resulting dual band antenna array is compact and the array elements have low to minimal interaction with each other. Similarly, other array configurations are also possible. A high band antenna array can be constructed using just high band antenna array elements according to the various embodiments of the present invention.

Figure 12:
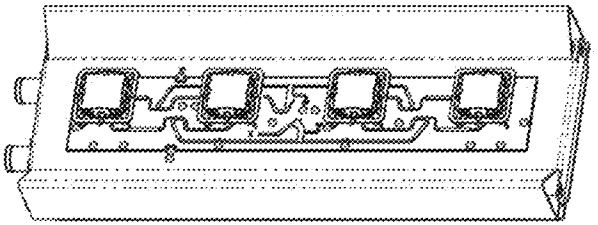
FIGS. 12-14 illustrate high band antenna arrays which use the antenna array element illustrated in FIGS. 1 and 2.
Figure 13:
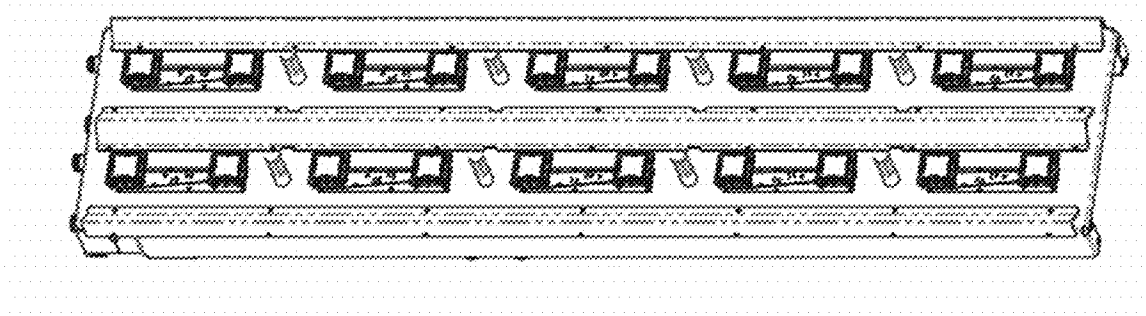
Figure 14:
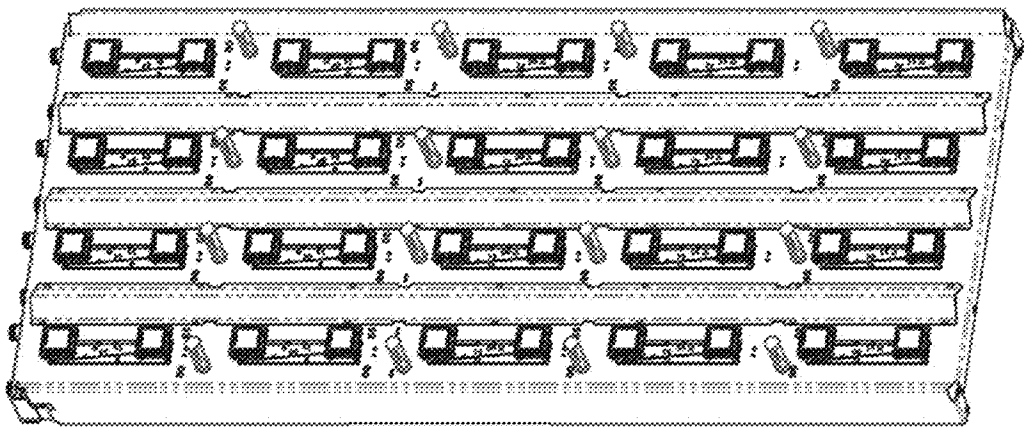

Referring to FIGS. 12-14, three different embodiments of a high band antenna array using the antenna array element are illustrated. FIG. 12 shows a two-port small cell antenna array with +/−45 degree polarization with a 65 degree azimuth beamwidth. In this array, the four elements are fed by an integrated feed board. FIG. 13 shows a four-port +/−45 degree polarization antenna with a 65 degree azimuth beamwidth. This array uses two linear arrays in parallel and the elements are divided into groups of two elements, each group being fed by a 5-output phase shifter. FIG. 14 illustrates an eight-port +/−45 degree polarization antenna with a 65 degree azimuth beamwidth. For this array, four linear arrays are placed in parallel. Each of the linear arrays in FIG. 14 has 10 elements and these 10 elements are divided into groups of 2 elements with each group being fed by a 5-output phase shifter.

Figure 15:
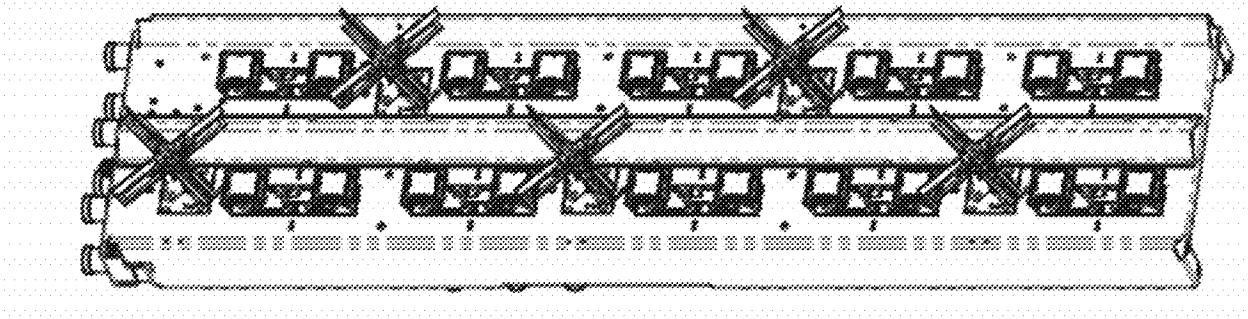
FIGS. 15-16 show dual band antenna arrays which use both kinds of antenna array elements illustrated in FIGS. 1-4.
Figure 16:
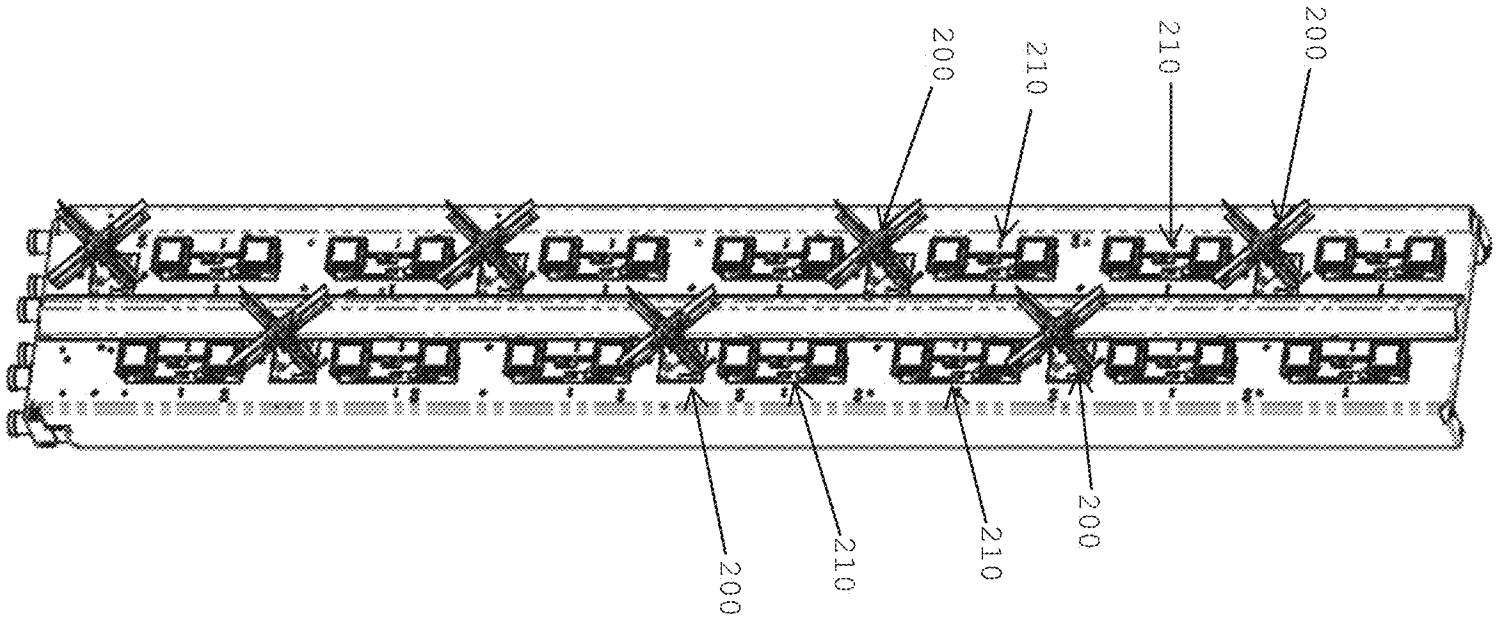

FIGS. 15 and 16 show dual band antenna arrays which use both the embodiments illustrated in FIGS. 1 and 2 and in FIGS. 3 and 4. FIG. 15 shows a 6-port broadband dual band array that is only 4 feet in length while FIG. 16 shows a 6 foot version of the same antenna array. As can be seen, in both versions, for every pair of lined up low band antenna array elements 200, there is positioned two high band antenna array elements 210 between them. For the high band array elements, non-uniform spacing between the elements is used and for the low band elements, the large spacing between similar elements helps in reducing the coupling between the low band and high band array elements.

It should also be noted that experiments have shown that, for the most desirable results for a dual band array, the height of the high band antennas should be related to the wavelength of the highest frequency of the low band. Specifically, the height of the high band antenna is preferably less than 0.05λ where λ is the wavelength of the highest frequency in the low band range for the array. Similarly, the combined dipole length of the high band antenna should be less than 0.17λ, again where λ is the wavelength of the highest frequency in the low band frequency range for the array.

A person understanding this invention may now conceive of alternative structures and embodiments or variations of the above all of which are intended to fall within the scope of the invention as defined in the claims that follow.

What is claimed is:

1. A dipole antenna comprising: a dipole antenna comprising: a pair of arms extending outwardly from a center and spaced apart from a ground plane, said pair of arms having a combined length ranging from 0.25λ to 0.5λ another pair of arms also extending outwardly from said center and spaced apart from said ground plane: wherein each pair of arms has a combined length ranging from 0.25λ to 0.5λ wherein each pair of arms has a combined length of approximately 0.28λ and said antenna has a height of approximately 0.15λ; wherein said dipole antenna has a height ranging from 0.15λ to 0.25λ as measured from said ground plane; λ, being equal to a wavelength of a lowest frequency of a signal to be used with said dipole antenna, and wherein said dipole antenna further comprises at least one continuous strip of conductive material enclosing an area adjacent said pairs of arms, said at least one continuous strip being spaced apart from and physically unconnected with said pairs of arms, said at least one continuous strip being for modifying an overall impedance of said dipole antenna.

2. The dipole antenna according to claim 1, wherein said dipole antenna is for use with signals having a frequency ranging from 698 MHz to 2800 MHz.

3. The dipole antenna according to claim 1, wherein said arms are capacitively coupled to circuitry on said dipole antenna.

4. The dipole antenna according to claim 1, wherein said at least one continuous strip conforms to a cross-sectional perimeter around said pairs of arms.

5. The dipole antenna according to claim 1, wherein said at least one continuous strip defines a specific shape adjacent said arms, said shape being one of: a circle; a square; a rectangle; and a cross.

6. The dipole antenna according to claim 5, further comprising a patch component for modifying an impedance of said dipole antenna.

7. The dipole antenna according to claim 6, wherein said patch component is a patch of conductive material located such that said pairs of arms is between said patch component and said ground plane.

8. The dipole antenna according to claim 7, wherein said dipole antenna is for use with signals having a frequency of between 1695-2690 MHz.

9. The dipole antenna according to claim 4, wherein each pair of arms has a combined length of approximately 0.33λ and said antenna has a height of approximately 0.18λ.

10. The dipole antenna according to claim 9, wherein said dipole antenna is for use with signals having a frequency of between 698-960 MHz.

11. The dipole antenna according to claim 1, wherein each arm is mechanically attached to a base and is electrically unconnected to said base, each arm being capacitively coupled to a circuit on said base.

12. A dipole antenna comprising: a pair of arms extending outwardly from a center and spaced apart from a ground plane, said pair of arms having a combined length ranging from 0.251 to 0.51; another pair of arms also extending outwardly from said center and spaced apart from said ground plane; wherein each pair of arms has a combined length ranging from 0.25λ to 0.5λ, wherein each pair of arms has a combined length of approximately 0.28λ and said antenna has a height of approximately 0.15λ; wherein said dipole antenna has a height ranging from 0.15λ to 0.25λ as measured from said ground plane; λ, being equal to a wavelength of a lowest frequency of a signal to be used with said dipole antenna, further comprising at least one continuous strip of conductive material enclosing an area adjacent said pairs of arms, said at least one continuous strip being spaced apart from and physically unconnected with said pairs of arms, said at least continuous one strip being for modifying an overall impedance of said dipole antenna, and wherein said at least one continuous strip conforms to a cross-sectional perimeter around said pairs of arms.

13. A dipole antenna comprising: a pair of arms extending outwardly from a center and spaced apart from a ground plane, said pair of arms having a combined length ranging from 0.25λ to 0.5λ; another pair of arms also extending outwardly from said center and spaced apart from said ground plane; wherein each pair of arms has a combined length ranging from 0.25λ to 0.5λ, wherein each pair of arms has a combined length of approximately 0.28λ and said antenna has a height of approximately 0.15λ; wherein said dipole antenna has a height ranging from 0.15λ to 0.25λ as measured from said ground plane; A, being equal to a wavelength of a lowest frequency of a signal to be used with said dipole antenna, further comprising at least one continuous strip of conductive material enclosing an area adjacent said pairs of arms, said at least one continuous strip being spaced apart from and physically unconnected with said pairs of arms, said at least one continuous strip being for modifying an overall impedance of said dipole antenna, wherein said at least one continuous strip defines a specific shape adjacent said arms, said shape being one of: a circle; a square; a rectangle; and a cross, and where the dipole antenna further comprising a patch component for modifying an impedance of said dipole antenna.

14. The dipole antenna according to claim 1, wherein said continuous strip is in the same footprint area of the two pairs of arms relative to the ground plane.

* * * * *